US006753838B2

(12) United States Patent
Kuijk et al.

(10) Patent No.: US 6,753,838 B2
(45) Date of Patent: Jun. 22, 2004

(54) DISPLAY DEVICE

(75) Inventors: Karel Elbert Kuijk, Eindhoven (NL); Leendert Marinus Hage, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 333 days.

(21) Appl. No.: 09/904,074

(22) Filed: Jul. 12, 2001

(65) Prior Publication Data

US 2002/0024492 A1 Feb. 28, 2002

(30) Foreign Application Priority Data

Jul. 13, 2000 (EP) ..... 00202485

(51) Int. Cl.[7] ..... G09G 3/36
(52) U.S. Cl. ..... 345/89; 345/94; 345/99
(58) Field of Search ..... 345/87, 89–100, 345/691–693, 204, 208

(56) References Cited

U.S. PATENT DOCUMENTS

| | | | | |
|---|---|---|---|---|
| 6,094,243 | A | 7/2000 | Yasunishi | 349/33 |
| 6,239,781 | B1 * | 5/2001 | Fujisawa | 345/691 |
| 6,353,435 | B2 * | 3/2002 | Kudo et al. | 345/204 |
| 6,377,234 | B1 * | 4/2002 | Nogawa | 345/89 |

FOREIGN PATENT DOCUMENTS

JP 09319342 12/1997 ..... G09G/3/36

OTHER PUBLICATIONS

Article by T.J. Scheffer and B. Clifton "Active Addressing Method for High–Contrast Video–Rate STN Displays", SID Digest 92, pp. 228–231.

* cited by examiner

*Primary Examiner*—Regina Liang

(57) ABSTRACT

A device for multiple row addressing is driven by frame addressing with pulse patterns based on sets of orthogonal functions. By choosing redundant frames with suitable frame lengths, a less varying frequency content is obtained than with pulse patterns obtained via frames based on a set of binary functions.

9 Claims, 1 Drawing Sheet

DISPLAY DEVICE

Figure 1:
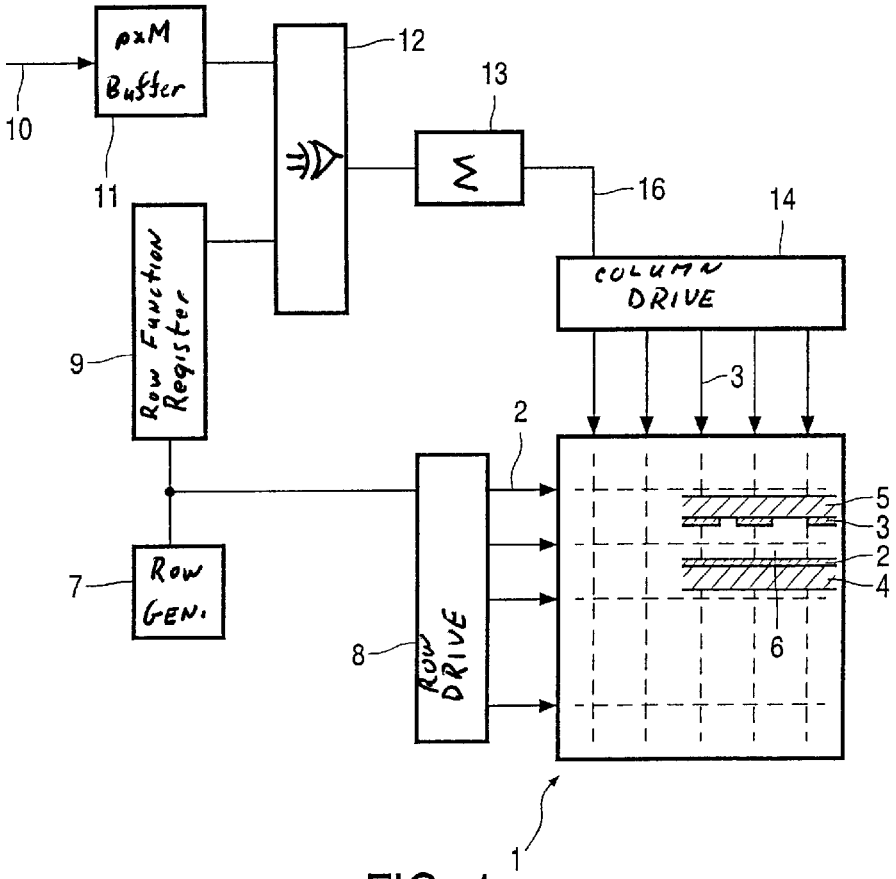

The invention relates to a display device comprising a liquid crystal material between a first substrate provided with row or selection electrodes and a second substrate provided with column or data electrodes, in which overlapping parts of the row and column electrodes define pixels, drive means for driving the column electrodes in conformity with an image to be displayed and drive means for driving the row electrodes which, in the operating state, sequentially supply groups of p row electrodes with mutually orthogonal signals. Such display devices are used in, for example, portable apparatus such as laptop computers, notebook computers and telephones.

Passive matrix displays of this type are generally known and are increasingly based on the STN effect (Super-Twisted Nematic) so as to be able to realize a high number of lines. An article by T. J. Scheffer and B. Clifton "Active Addressing Method for High-Contrast Video-Rate STN Displays", SID Digest 92, pp. 228–231 states how the phenomenon of frame response, which occurs in fast switching liquid crystal materials, is avoided by making use of Active Addressing. In this method, all rows are driven throughout the frame period with mutually orthogonal signals, for example, Walsh functions. The result is that each pixel is constantly excited by pulses (256 times per frame period in an STN-LCD of 240 rows) instead of once per frame period. In multiple row addressing, a (sub-)group of p rows is driven with mutually orthogonal signals. Since a set of orthogonal signals, such as Walsh functions, consists of a plurality of functions which is a power of 2, i.e. $2^s$, p is preferably chosen to be as equal as possible thereto, i.e. generally $p=2^s$ (or also $p=2^s-1$). The orthogonal row signals $F_i(t)$ are preferably square wave-shaped and consist of the voltages +F and −F, while the row voltage is equal to zero outside the selection period. The elementary voltage pulses constituting the orthogonal signals are regularly spread across the frame period. Thus, the pixels are then excited $2^s$ (or $(2^s-1)$) times per frame period with regular pauses, instead of once per frame period. Even for low values of p, such as p=4 (or 3) or p=8 (or 7), this appears to suppress the frame response just as well as driving all rows simultaneously, such as in Active Addressing, but much less electronic hardware is required for this purpose.

However, it appears that the realization of grey scales by means of this multiple row addressing mode causes quite some problems because the frequency contents of the voltage at a pixel strongly differs for different picture contents when using the conventional method such as binary division of frames or when using the split level method for the functions used. Since the dielectric constant of liquid crystalline material is frequency-dependent, this may cause the liquid crystalline material to react differently at different locations in, for example, a matrix display, dependent on the picture information. This leads to artefacts in the picture, notably to different forms of crosstalk.

It is, inter alia, an object of the present invention to provide a display device of the type described above, in which a minimal number of artefacts (crosstalk) occurs in the picture.

To this end, a display device according to the invention is characterized in that the drive means present mutually orthogonal signals to p row electrodes for realizing at most $(2^n+4)$ grey values (n>1) during (n+1) consecutive frames of different lengths, with a non-binary division of the frame lengths.

It appears that with such a choice of the number of grey values and the number of frames of different lengths, the differences in frame length may be small (particularly with respect to the customary binary division). Moreover, the ample choice of the number of possible adjustments of the effective value of the voltage across the pixel appears to provide the possibility of choosing a number of grey values which are spaced apart substantially equidistantly.

These and other aspects of the invention are apparent from and will be elucidated with reference to the embodiments described hereinafter.

IN THE DRAWINGS

Figure 2:
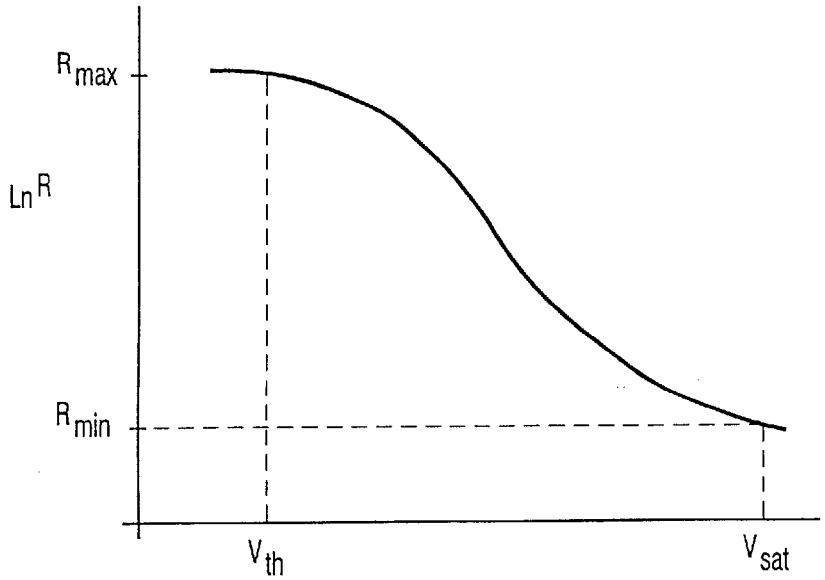

FIG. 1 diagrammatically shows a display device in which the invention is used and FIG. 2 shows the logarithm of the reflection ($Ln^R$) as a function of the effective voltage (RMS voltage) across a pixel.

FIG. 1 shows a display device with a matrix 1 of pixels at the area of crossings of N rows 2 and M columns 3 which are provided as row electrodes and column electrodes on opposite surfaces of substrates 4, 5, as can be seen in the cross-section shown in the matrix 1. The liquid crystal material 6 is present between the substrates. Other elements, such as orientation layers, polarizers etc. are omitted in the cross-section for the sake of simplicity.

The device further comprises a row function generator 7 which is in the form of, for example, a ROM, for generating orthogonal signals $F_i(t)$ for driving the rows 2. Similarly as described in said article by Scheffer and Clifton, row vectors are defined during each elementary time interval, which row vectors drive a group of p rows via drive circuits 8. The row vectors are written into a row function register 9.

Information 10 to be displayed is stored in a p×M buffer memory 11 and read as information vectors per elementary unit of time. Signals for the column electrodes 3 are obtained by multiplying, during each elementary unit of time, the then valid values of the row vector and the information vector and by subsequently adding the p obtained products. The multiplication of the values of the row and column vectors valid during an elementary unit of time is realized by comparing them in an array 12 of M exclusive ORs. The addition of the products is realized by applying the outputs of the array of exclusive ORs to the summing logic 13. The signals 16 from the summing logic 13 drive a column drive circuit 14 which provides the columns 3 with voltages $G_j(t)$ having p+1 possible voltage levels. Each time, p rows are driven simultaneously, in which P<N ("multiple row addressing"). The row vectors as well as the information vectors therefore have only p elements, which results in a saving of the required hardware such as the number of exclusive ORs and the size of the summing circuit, as compared with the method in which all rows are driven simultaneously with mutually orthogonal signals ("Active Addressing"). In this embodiment, the display device is assumed to be a reflective device, but it may also be a transmissive or transflective device, for which the same reasoning applies.

FIG. 2 shows the (natural logarithm of the) reflection of the display device as a function of the effective voltage (RMS voltage) across a pixel. Since also the sensitivity of the human eye is proportional to the logarithm of the incident light, equidistant grey values (for example, 16 grey values) can be easily fixed by dividing the vertical axis between $(\text{In } R)_{max}$ and $(\text{In } R)_{min}$ into 15 equal parts in the case of a linear variation between the maximum value $(\text{In } R)_{max}$ and the minimum value $(\text{In } R)_{min}$. Since the graph is not a straight line in practice, but is more S-shaped, the associated division of voltages on the abscissa will not be equidistant. The mutual distances are larger than in the central part, notably near the black and white ranges.

For a liquid crystal cell it holds, for example, that $R_{max}=94.74$ at $V_{th}=1.9$ V, so that $(\text{In } R)_{max}=4.5512$, while $R_{min}=11.60$ at $V_{sat}=2.08$ V, so that $(\text{In } R)_{min}=2.4512$. The steps in (In R) must thus have a value of $\Delta(\text{In } R)=((\text{In } R)_{max}-(\text{In } R)_{min})/15=0.14$.

On this basis, the Table below can be made for 16 different reflection levels and the associated voltage levels.

| Grey value | ln R | Reflectivity (R) | Voltage (V) |
|---|---|---|---|
| 0 | 2.4512 | 11.60 | 2.080 |
| 1 | 2.5912 | 13.35 | 2.060 |
| 2 | 2.7312 | 15.35 | 2.053 |
| 3 | 2.8712 | 17.66 | 2.048 |
| 4 | 3.0112 | 20.31 | 2.042 |
| 5 | 3.1512 | 23.36 | 2.037 |
| 6 | 3.2912 | 26.88 | 2.032 |
| 7 | 3.4312 | 30.91 | 2.027 |
| 8 | 3.5712 | 35.56 | 2.022 |
| 9 | 3.7112 | 40.90 | 2.016 |
| 10 | 3.8512 | 47.05 | 2.009 |
| 11 | 3.9912 | 54.12 | 2.001 |
| 12 | 4.1312 | 62.25 | 1.992 |
| 13 | 4.2712 | 71.61 | 1.981 |
| 14 | 4.4112 | 82.37 | 1.963 |
| 15 | 4.5512 | 94.74 | 1.900 |

It is clear from this Table that the steps in the effective voltage are smallest in the central part of the grey scale, namely approximately 5 mV. Since the entire voltage range is 2080−1900=180 mV, 36 steps are needed to cover the entire range. In the range near the two extremes (white and black) the steps are much larger so that, according to the invention, the frame lengths are chosen with a mutual ratio of 9:8:7:6:4 (sum=34 so that the smallest possible step is 1/34 of the total range: this is very close to the desired step of 1/36) or of 10:9:8:7:4 (sum=38, the smallest possible step is now 1/38 of the total range).

For the choice of frame lengths (9:8:7:6:4) at which the pixel is switched on or switched off within each frame, the following 27 grey values can be generated: 0, 4, 6, 7, 8, 9, 10, 11, 12, 13, 14,, 15, 16, 17, 18, 19, 20, 21, 22, 23, 24, 25, 26, 27, 28, 30, 34. However, not all of these are required. The smallest possible step of the effective voltage of 180/34=5.3 mV is small enough for the central part of the grey scale. For a grey scale with 16 levels (grey values), for example the following 16 values are chosen.

| Selected level | Grey value | Voltage (V) | Desired voltage (V) (see previous Table) | Deviation (mV) |
|---|---|---|---|---|
| 0 | 0 | 2.080 | 2.080 | 0 |
| 4 | 1 | 2.060 | 2.060 | 0 |
| 6 | 2 | 2.049 | 2.053 | −4 |
| 7 | 3 | 2.044 | 2.048 | −4 |
| 8 | 4 | 2.039 | 2.042 | −3 |
| 9 | 5 | 2.034 | 2.037 | −3 |
| 10 | 6 | 2.029 | 2.032 | −3 |
| 11 | 7 | 2.024 | 2.027 | −3 |
| 12 | 8 | 2.018 | 2.022 | −4 |
| 13 | 9 | 2.013 | 2.016 | −3 |
| 14 | 10 | 2.008 | 2.009 | −1 |
| 15 | 11 | 2.003 | 2.001 | +2 |
| 17 | 12 | 1.992 | 1.992 | 0 |
| 19 | 13 | 1.981 | 1.981 | 0 |
| 22 | 14 | 1.965 | 1.963 | +2 |
| 34 | 15 | 1.900 | 1.900 | 0 |

It appears from the Table that the grey values obtained at this choice deviate to only a very small extent from the ideal values.

It appears from measurements that the crosstalk is also small because the smallest frame length is 4/9 part of the largest frame length and 2/17 part of the total frame length. The number of high frequencies in the range where the dielectric constant of the liquid crystalline material strongly differs from that in the usual frequency domain is thereby small. An extra advantage is that the grey levels are now equidistant, as described. hereinbefore. With a binary division (frame lengths 8:4:2:1) a choice of 32 levels would have been obvious. The smallest possible step is then 1/32, i.e. close to the desired 1/36. However, the smallest frame length is then 1/16 of the largest frame length and 1/31 of the total frame length. This leads to much higher frequencies in the voltage across a pixel and hence to serious artefacts (crosstalk).

Similar advantages are obtained for the choice of frame lengths (10:9:8:7:4); now, the following 29 grey values can be generated: 0, 4, 7, 8, 9, 10, 11, 12, 13, 14, 15, 16, 17, 18, 19, 20, 21, 22, 23, 24, 25, 26, 27, 28, 29, 30, 31, 34, 38. For a grey scale with 16 levels (grey values), for example, the following 16 values are now chosen.

| Selected level | Grey value | Voltage (V) | Desired voltage (V) | Deviation (mV) |
|---|---|---|---|---|
| 0 | 0 | 2.080 | 2.080 | 0 |
| 4 | 1 | 2.062 | 2.060 | +2 |
| 7 | 2 | 2.048 | 2.053 | −5 |
| 8 | 3 | 2.043 | 2.048 | −5 |
| 9 | 4 | 2.039 | 2.042 | −3 |
| 10 | 5 | 2.034 | 2.037 | −3 |
| 11 | 6 | 2.030 | 2.032 | −2 |
| 12 | 7 | 2.025 | 2.027 | −2 |
| 13 | 8 | 2.020 | 2.022 | −2 |
| 14 | 9 | 2.016 | 2.016 | 0 |
| 15 | 10 | 2.011 | 2.009 | +2 |
| 17 | 11 | 2.001 | 2.001 | 0 |
| 19 | 12 | 1.992 | 1.992 | 0 |
| 21 | 13 | 1.983 | 1.981 | +2 |
| 25 | 14 | 1.963 | 1.963 | 0 |
| 38 | 15 | 1.900 | 1.900 | 0 |

More generally, it holds that the consecutive frames should have a mutual time duration ratio of (k+3): (k+2): (k+1): k:a with a≧2 and k≧1.

For generating 8 grey values, the range between $(\text{In R})_{max}$ and $(\text{In R})_{min}$ must be divided into 7 equal parts on the vertical axis. The steps in (In R) must thus have a value of $\Delta(\text{In R})=((\text{In R})_{max}-(\text{In R})_{min})/7=0.3$. On this basis, the Table below can be made for 8 different reflection levels (or transmission levels) and the associated voltage levels.

| Grey value | ln R | Reflectivity (R) | Voltage (V) |
|---|---|---|---|
| 0 | 2.4512 | 11.60 | 2.080 |
| 1 | 2.7512 | 15.66 | 2.052 |
| 2 | 3.0512 | 21.14 | 2.041 |
| 3 | 3.3512 | 28.54 | 2.030 |
| 4 | 3.6512 | 38.52 | 2.018 |
| 5 | 3.9512 | 52.00 | 2.004 |
| 6 | 4.2512 | 70.19 | 1.983 |
| 7 | 4.5512 | 94.74 | 1.900 |

The desired voltages can be obtained by means of frame lengths (5:4:3:2). The following 13 grey values can be generated therewith: 0, 2, 3, 4, 5, 6, 7, 8, 9, 10, 11, 12, 14. However, again not all of these are required. For a grey scale with 8 levels (grey values), for example, the following 8 values are chosen:

| Selected level | Grey value | Voltage (V) | Desired voltage (V) (see previous Table) | Deviation (mV) |
|---|---|---|---|---|
| 0 | 0 | 2.080 | 2.080 | 0 |
| 2 | 1 | 2.055 | 2.052 | +3 |
| 3 | 2 | 2.043 | 2.041 | +2 |
| 4 | 3 | 2.030 | 2.030 | 0 |
| 5 | 4 | 2.018 | 2.018 | 0 |
| 6 | 5 | 2.005 | 2.004 | +1 |
| 8 | 6 | 1.979 | 1.983 | −4 |
| 14 | 7 | 1.900 | 1.900 | 0 |

The grey values obtained deviate very little from the ideal values.

For realizing 4 grey values, the range between $(\text{In R})_{max}$ and $(\text{In R})_{min}$ must be divided into 3 equal parts on the vertical axis. The steps in (In R) must thus have a value of $\Delta(\text{In R})=(\text{In R})_{max}-(\text{In R})_{min})/3=0.7$. On this basis, the Table below can be made of 4 different reflection levels (or transmission levels) and the associated voltage levels.

More generally, a ratio of (k+2): (k+1): k:a, k≧1, a≧2 again holds for consecutive frames.

| Grey value | ln R | Reflectivity (R) | Voltage (V) |
|---|---|---|---|
| 0 | 2.4512 | 11.60 | 2.080 |
| 1 | 3.1512 | 23.36 | 2.037 |
| 2 | 3.8512 | 47.05 | 2.009 |
| 3 | 4.5512 | 94.75 | 1.009 |

The desired voltages can be obtained, for example, with frame lengths of (7:6:4). The following 8 grey values can be generated therewith: 0, 4, 6, 7, 10, 11, 13, 17. However, not all of these values are required. For a grey scale with 4 levels (grey values), for example the following 4 values are chosen.

| Selected level | Grey value | Voltage (V) | Desired voltage (V) (see previous Table) | Deviation (mV) |
|---|---|---|---|---|
| 0 | 0 | 2.080 | 2.080 | 0 |
| 4 | 1 | 2.039 | 2.037 | +2 |
| 7 | 2 | 2.008 | 2.009 | −1 |
| 17 | 3 | 1.900 | 1.900 | 0 |

The desired voltages can also be obtained with frame lengths (4:2:2). The following 8 grey values can be generated therewith: 0, 2, 3, 4, 5, 6, 7, 9. For a grey scale with 4 levels (grey values), for example, the following 4 values are chosen.

| Selected level | Grey value | Voltage (V) | Desired voltage (V) | Deviation (mV) |
|---|---|---|---|---|
| 0 | 0 | 2.080 | 2.080 | 0 |
| 2 | 1 | 2.041 | 2.037 | +4 |
| 4 | 2 | 2.002 | 2.009 | −7 |
| 9 | 3 | 1.900 | 1.900 | 0 |

More generally, a ratio of (k+1): k:a with a≧2, k≧1 holds again.

The invention is of course not limited to the embodiments described. As stated, the invention may also be used for a transmissive display device. The grey scale can also be divided into more equidistant parts (for example, 20 instead of 16, but also a lower number than 16 is possible) with a small adaptation, if necessary, to the choice of the frame lengths.

The protective scope of the invention is not limited to the embodiments described. The invention resides in each and every novel characteristic feature and each and every combination of characteristic features. Reference numerals in the claims do not limit their protective scope. Use of the verb "to comprise" and its conjugations does not exclude the presence of elements other than those stated in the claims. Use of the article "a" or "an" preceding an element does not exclude the presence of a plurality of such elements.

What is claimed is:

1. A display device comprising a liquid crystal material between a first substrate provided with row or selection electrodes and a second substrate provided with column or data electrodes, in which overlapping parts of the row and column electrodes define pixels, a column driver that is configured to drive the column electrodes in conformity with an image to be displayed, and a row driver that is configured to drive the row electrodes which, in the operating state, sequentially supply groups of p row electrodes with p mutually orthogonal signals, characterized in that the row driver supplies mutually orthogonal signals to p row electrodes and the column driver supplies voltages for realizing a plurality of grey values during a plurality of frames corresponding to an image frame, with a non-binary division of the frame lengths of each frame of the plurality of frames, and with a consistent correspondence among the plurality of frames between the voltage supplied by the column driver and a corresponding grey value of the plurality of grey values.

2. A display device as claimed in claim 1, characterized in that $2^n$ grey values are realized among (n+1) frames.

3. A display device as claimed in claim 1, characterized in that, the frame lengths of at least three frames of the plurality of frames have a mutual time duration ratio of $(2^{n-1}+1)$: $2^{n-1}$: $(2^{n-1}-1)$.

4. A display device as claimed in claim 1, characterized in that the frame lengths of at least five frames of the plurality of frames have a mutual time duration ratio of (k+3): (k+2): (k+1): k: a.

5. A display device as claimed in claim 4, characterized in that the frames have a mutual time duration ratio of 9:8:7:6:4 or 10:9:8:7:4.

6. A display device as claimed in claim 1, characterized in that the frame lengths of at least four frames of the plurality of frames have a mutual time duration ratio of (k+2): (k+1): k: a.

7. A display device as claimed in claim 6, characterized in that the frames have a mutual time duration ratio of 5:4:3:2.

8. A display device as claimed in claim 1, characterized in that the frame lengths of at least three frames of the plurality of frames have a mutual time duration ratio of (k+1): k: a.

9. A display device as claimed in claim 8, characterized in that the frames have a mutual time duration ratio of 7:6:4 or of 4:3:2.

* * * * *